US006422224B1

(12) United States Patent
Walker, Jr.

(10) Patent No.: US 6,422,224 B1
(45) Date of Patent: Jul. 23, 2002

(54) REMOTE AIR-OIL SEPARATOR

(75) Inventor: Robert A. Walker, Jr., Santa Clarita, CA (US)

(73) Assignee: Walker Design, Inc., Sun Valley, CA (US)

( * ) Notice: Subject to any disclaimer, the term of this patent is extended or adjusted under 35 U.S.C. 154(b) by 0 days.

(21) Appl. No.: 09/705,212

(22) Filed: Nov. 2, 2000

(51) Int. Cl.[7] ..... F02M 25/06
(52) U.S. Cl. ..... 123/572; 123/573
(58) Field of Search ..... 123/572, 573, 123/574, 41.86

(56) References Cited

U.S. PATENT DOCUMENTS

| | | | | | |
|---|---|---|---|---|---|
| 2,385,814 | A | | 10/1945 | Kamrath | |
| 3,277,876 | A | | 10/1966 | Abts | |
| 3,614,859 | A | | 10/1971 | Clark | |
| 3,721,069 | A | | 3/1973 | Walker | |
| 3,789,582 | A | | 2/1974 | Graybill | |
| 4,167,164 | A | * | 9/1979 | Bachmann | 123/573 |
| 4,184,858 | A | | 1/1980 | Walker | |
| 4,409,950 | A | * | 10/1983 | Goldberg | 123/573 |
| 4,653,457 | A | | 3/1987 | Stege | 123/572 |
| 4,724,807 | A | | 2/1988 | Walker | |
| 4,861,359 | A | | 8/1989 | Tettman | |
| 4,947,806 | A | | 8/1990 | Speer et al. | 123/41.86 |
| 5,140,957 | A | | 8/1992 | Walker | |
| 5,201,301 | A | * | 4/1993 | Re | 123/573 |
| 5,347,973 | A | | 9/1994 | Walker, Jr. | |
| 5,450,835 | A | * | 9/1995 | Wagner | 123/573 |
| 5,479,907 | A | | 1/1996 | Walker, Jr. | |
| 5,494,020 | A | * | 2/1996 | Meng | 123/572 |
| 5,564,401 | A | * | 10/1996 | Dickson | 123/573 |
| 6,009,846 | A | | 1/2000 | Walker, Jr. | |

* cited by examiner

*Primary Examiner*—Marguerite McMahon
(74) *Attorney, Agent, or Firm*—Christie, Parker & Hale, LLP

(57) ABSTRACT

Air-oil separators of this invention comprise a housing having an internal chamber defined by a housing sidewall surface that extends axially from a housing base to a housing open end. The open end includes a removable lid disposed thereon. The housing includes an inlet for receiving an air-oil mixture into the internal chamber from an internal combustion engine, and an outlet for passing a separated air stream from the internal chamber and out of the housing. An oil coalescing filter element is removably disposed within the internal chamber and is positioned/interposed between the inlet and outlet. A vacuum control device is disposed onboard or off board of the separator to provide a vacuum regulated environment within the housing internal chamber between the inlet and outlet. Thus configured, air-oil separators of this invention provide improved air and oil separation efficiencies when compared to conventional air-oil separators.

24 Claims, 5 Drawing Sheets

300
328
326
306
330

300
306
310
302
312
308
304
303
324
322
314
316
319
318
320
332

REMOTE AIR-OIL SEPARATOR

FIELD OF THE INVENTION

The present invention relates generally to air-oil separators useful for separating oil from an entering air-oil mixture and, more specifically, to an air-oil separator mounted remote from an engine air filter and comprising a serviceable oil coalescing filter for separating oil in a vacuum regulated environment.

BACKGROUND OF THE INVENTION

Increasingly stringent environmental regulations, and a heightened consciousness of environmental conservation, has mandated cleaner operation of hydrocarbon powered sources such as automobiles, boats, trucks, motorcycles, or the like. As a result, blow-by devices such as pollution control valves have become required standard equipment for all automobiles. These blow-by devices capture air-oil emissions from the crankcase of a hydrocarbon burning internal combustion engine and direct them in a closed system to the engine air intake system for subsequent combustion. The emissions generated from the crankcase of diesel engines, for example, are heavily ladened with oil and other heavy hydrocarbons. Accordingly, devices, such as air-oil separators, have been developed in an effort to make the operation of such engines cleaner and more efficient. These devices are designed to filter inlet air routed to an intake of an engine, separate oil and other hydrocarbons emitted from a contaminated engine atmosphere, and regulate the pressure within an engine crankcase.

Typical air-oil separators are designed to both filter air prior to entering an engine intake system, and separate an air-oil mixture received from an engine crankcase into its liquid and gas constituents. Such air-oil separators have an inside chamber or portion that is configured to mechanically separate oil from the entering air-oil mixture. More specifically, such air-oil separator includes a primary air inlet that is connected to an engine intake system, and that creates an internal vacuum within the device for receiving the air-oil mixture. The air-oil mixture is passed through one or more internal baffles and/or filter material for effecting oil separation. The separated oil component is collected and removed from the separator for either further treatment or for routing back to an engine crankcase. The separated air component is directed to the primary air inlet and into the engine intake system for combustion.

Such intake mounted air filter/air-oil separators are ideally operated in conjunction with a vacuum limiting device that serves to prevent the pressure differential between the separator and engine crankcase from reaching a predetermined maximum. The use of a vacuum limiting device helps to prevent the unwanted carryover and passage of oil from the crankcase into the separator under operating conditions of a large pressure differential between the separator and crankcase.

Air filter/air-oil separator devices comprising external vacuum limiting devices are known in the art, wherein the vacuum limiting device is positioned between an air-oil mixture inlet into the separator and the crankcase. While such external vacuum limiting devices do function to limit/control the amount of vacuum that is directed to the engine crankcase from the separator, the placement such a vacuum limiting device external from the separator causes the inside portion of the separator to be subjected to a relatively high unregulated vacuum of in the range of from about 10 to 35 inches. Thus, the only portion of a system comprising such an external vacuum limiting device that operates within a vacuum regulated environment is the engine crankcase.

A result of such uncontrolled vacuum within the separator is that the air-oil mixture entering the separator for separation is directed through the housing at a relatively quick velocity, thereby reducing the reduced residence time of the mixture within the housing and limiting air-oil separation efficiency. Additionally, the relatively large vacuum maintained within the separator during the course of operation tends to limit the oil removal efficiency from the separator due to a cavitation-like effect that impairs gravity drainage of the collected oil from the separator.

Previous attempts have been made to design air-oil separators to address the problem described above. One such system is described in U.S. Pat. No. 5,564,401, the disclosure of which is incorporated herein by reference. This patent discloses a closed crankcase emission control assembly comprising pressure-control assembly, a filter, and an oil drain check valve. The assembly is generally configured having an inlet passage, a pressure control assembly disposed downstream of the inlet passage, a filter channel disposed downstream of the pressure control assembly, a barrier filter positioned within a filter housing and downstream from the filter channel, and an outlet passage positioned downstream from the barrier filter. This device is designed to be mounted remote from an engine intake system, and is configured with its inlet passage connected to an engine crankcase for receiving an air-oil mixture, and its outlet passage connected to an engine intake system.

Configured in this manner, the patented device operates to receive an air-oil mixture from an engine crankcase into its inlet passage, pass the mixture through its pressure-control assembly and through the barrier further where the oil constituent is separated and collected for removal, and pass the separated air constituent out of the device via the outlet passage. However, this device suffers from the same problem noted above; namely, that the pressure-control assembly is positioned upstream from the barrier filter so that inside portion of the device is not disposed within a vacuum regulated environment. Rather, the only portion of the device that is subjected to a vacuum regulated environment is the inlet passage. Thus, this device too suffers from the air-oil separation and oil removal inefficiencies described above.

There is, therefore, is a need to provide an air-oil separator that is configured having an air-oil separation chamber subjected to a vacuum regulated environment to increase air-oil mixture residence time therein for purposes of further increasing air-oil separation efficiency. It is further desired that an air-oil separator be configured having a vacuum regulated environment for purposes of increasing oil removal efficiency by gravity drainage. It is also desirable that the device be constructed in a manner that allows it be positioned at a location remote from the engine and other high-temperature components, be easy to install and use without a need for special equipment or instruction, and be serviceable to extend the useful service life of the device.

SUMMARY OF THE INVENTION

The present invention comprises a remote air-oil separator for use with internal combustion engines for imposing a slight vacuum onto an engine crankcase and separating an air-oil mixture removed from the crankcase into its air and oil constituents for further treatment or for respective recombination with intake air for combustion and replacement into the engine crankcase. Air-oil separators of this invention are remote in that they are configured to be placed and/or attached separate from an engine intake housing, and have a vacuum regulated environment to provide improved air and oil separation efficiency over conventional air-oil separators.

Air-oil separators of this invention comprise a housing having an internal chamber defined by a housing sidewall surface that extends axially from a housing base to a housing open end. The open end includes a removable lid disposed thereon. The housing includes an inlet for receiving an air-oil mixture into the internal chamber from an internal combustion engine, and an outlet for passing a separated air stream from the internal chamber and out of the housing. An oil coalescing filter element is removably disposed within the internal chamber and is positioned/interposed between the inlet and outlet. Means for controlling a pressure differential within the housing internal chamber between the inlet and outlet is positioned downstream from the filter and in communication with the outlet and a vacuum generating source.

The means for controlling can be mounted onboard or off board the separator and is configured to impose a controlled amount of vacuum within the housing, i.e., provide a regulated vacuum environment, to control the volumetric flow rate and residence time of the air-oil mixture through and within the housing and filter element. Thus configured, air-oil separators of this invention provide improved air and oil separation efficiencies when compared to conventional air-oil separators. Air-oil separators of this invention can be used in conjunction with onboard or off board prefilters disposed within the air-oil mixture flow path upstream of filter element that functions as a first stage filtration element to the primary oil coalescing filter element to improve the service life of the primary filter element.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION OF THE INVENTION

Air-oil separators, constructed according to principles of this invention, generally comprises a housing including an inlet for receiving an air-oil mixture, and an outlet for passing a separated air mixture to an engine intake system. The housing is configured to be mounted remote from the engine and engine intake air filter assembly, and includes a serviceable oil coalescing filter disposed therein for separating the oil constituent from the mixture, and an oil drain for removing collected oil from the housing. A vacuum control device is positioned either externally or internally to provide a vacuum regulated environment within the housing to optimize efficient separation, collection, and removal of oil.

Figure 1B:
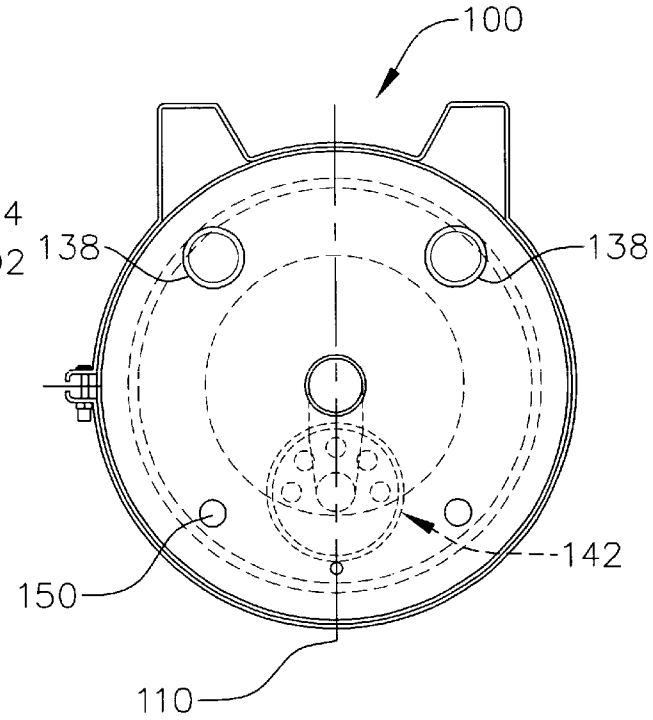
FIGS. 1A and 1B are a cross-sectional side view and a top plan view, respectively, of a first embodiment air-oil separator constructed according to principles of this invention.
Figure 1A:
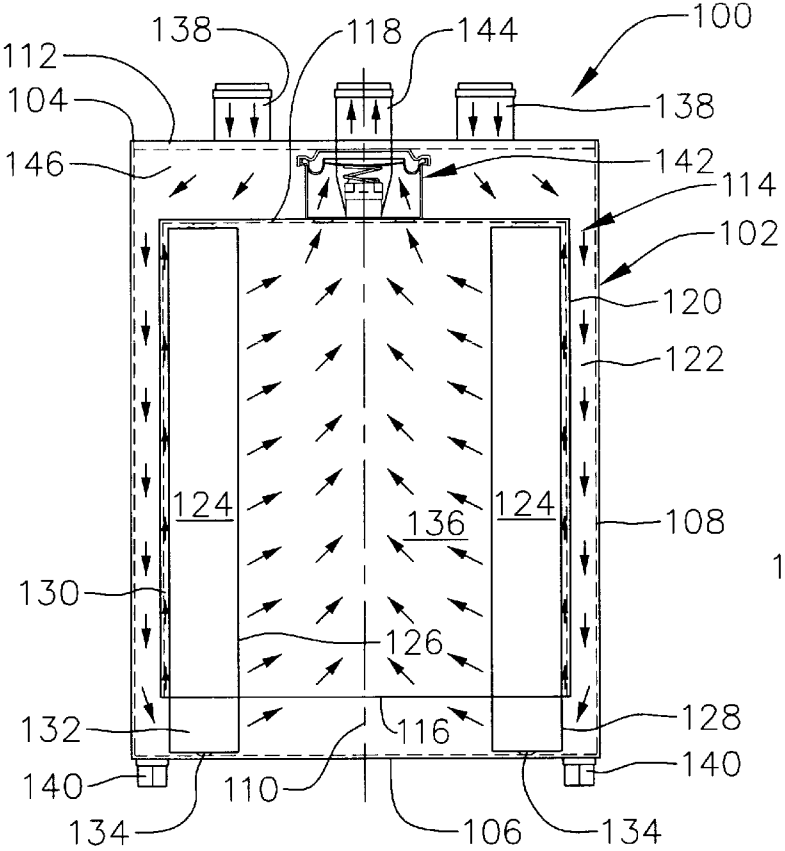

FIGS. 1A and 1B illustrate a first example embodiment remote air-oil separator apparatus 100 for separating air-oil contaminants (including oil and other heavy hydrocarbons) from pressurized air-contaminant mixtures routed to the apparatus from an engine crankcase. The apparatus or separator 100 comprises a substantially cylindrical separator housing 102 having an open top 104 at one housing axial end, a closed base 106 at an opposite axial end forming a bottom of the housing, and a sidewall 108 extending axially between the base and open top. The housing 102 may be formed from aluminum, sheet metal or other structural material suitable for withstanding the temperature and environment proximate internal combustion. The housing is substantially symmetrical about axis 110. A substantially disk-shaped lid 112 is removably attached over the housing open top 104. A rubber gasket (not shown) is interposed between the lid and the housing open top to provide an air-tight seal therebetween.

Moving axially downwardly from the lid, the separator housing 102 includes a filter housing 114 that is removably disposed concentrically therein. The filter housing 114 is substantially cylindrical in shape and includes an open end 116 at an axial end, positioned adjacent the separator housing base 106, a closed end 118 at an axial end opposite from the open end 116, positioned adjacent the separator housing open top 104, and an annular sidewall 120 extending axially downwardly from the closed end 118 to the open end 116. The filter housing 114 has a sidewall outside diameter that is sufficiently less than the separator housing sidewall inside diameter to define an air-oil mixture passageway 122 therebetween. The filter housing 114 is oriented symmetrically about the central axis 28. The filter housing 114 can be formed from the same types of materials discussed above for forming the separator housing 102.

An annular oil coalescing filter element 124 is removably disposed concentrically within the filter housing 114, and is oriented symmetrically about the central axis 110. The filter element 124 comprises an inside diameter surface 126 and an outside diameter surface 128. The filter element is sized having an outside diameter that is sufficiently less than that of the filter housing sidewall inside diameter to define an annular air-oil mixture passageway 130 therebetween. The filter element can be made from conventional filter materials such as paper, polymeric materials, foam and the like. In an example embodiment, the filter element is formed from fiberglass and cellulose.

The filter element 124 is sized having an axial height that is greater than the axial height of the filter housing annular sidewall 120 so that a section of the filter element 132 projects outwardly away from the filter housing open end 116. The filter element and filter housing are intentionally configured in this manner to provide a preferential flow path of the air-oil mixture through the exposed section of the filter element.

The filter element 124 includes means 134, located at each opposite axial end, for providing a leak-tight seal against the respective filter housing closed end 118 and the separator housing base 106. In an example embodiment, the filter element includes axial ends that are formed from an elastomeric material, e.g., rubber, and sealing means in the form of annular tabs 134 that extend around the axial ends and project outwardly a distance therefrom. The separator housing base and filter housing closed end may each include annular grooves disposed therein that are positioned to accommodate a portion of the filter element tabs, and that additionally serve to help center the filter element vis-a-vis the separator and filter housings. The filter element inner surface 126 defines a chamber 136 within the filter housing for receiving separated air from the filter element. The filter element is intended to be serviceable or replaceable by simply removing the separator housing lid, and withdrawing the filter element from the filter housing.

Returning to the top of the separator housing 102, one or more inlet ports 138 project axially outwardly from the lid 112. In an example embodiment, the separator housing comprises two inlet ports 138. The inlet ports 138 are preferably riveted or spot welded to the lid and, in a preferred embodiment, are positioned approximately 45 degrees apart from each other (as best shown in FIG. 1B). The inlet ports provide a gas flow path for receiving air-oil mixtures from an engine crankcase and passing them into the internal chamber of the separator housing 102. The inlet ports 138 are sized and configured to accommodate attachment via suitable tubing or hosing to an internal combustion engine as mote fully described below.

Moving to the bottom of the separator housing 102, one or more oil drain couplings 140 are preferably disposed through the housing base 106 to facilitate drainage and removal of separated oil from the separator housing. The drain coupling is preferably positioned radially within the separator housing between the housing wall 108 and the filter outer surface 128 so that the oil that is coalesced and separated outside of the filter element can gravity drain to the coupling. In an example embodiment, the separator housing comprises a pair of oil drain couplings 140. The oil drain couplings are sized and configured to accommodate attachment with hoses or other similar conduits for routing the collected and removed oil for further treatment or back to the engine block. A check valve (see FIG. 5) is coupled in a conventional manner between the hose and the engine block, to prevent back flow of oil from the crankcase to the interior of the separator housing.

In this first example embodiment, a vacuum control means 142 is disposed within the separator and is attached to the filter housing closed end 118 at a position radially inward from the filter element. The vacuum control means 142 can be in the form of a diaphragm operated vacuum regulator, and can be attached to the filter housing closed end by conventional method such as by welding, rivoting and the like. Accordingly, in this first example embodiment, the vacuum control means is considered to be an integral member of the separator. The vacuum regulator 142 is positioned axially in an airspace between the filter housing closed end 118 and the separator housing lid 112.

The vacuum regulator 142 is placed in air-flow communication with the chamber 136 to control the amount of vacuum imposed within the housing, i.e., between the vacuum regulator and the air-oil mixture inlet ports 138, by a vacuum source such as an air stream passing to an engine intake system. Such regulated or controlled vacuum within the separator provides a reduced air-mixture travel velocity within the separator, and an increased air-oil mixture residence time within the separator, thereby serving to enhance air-oil separation.

The air-oil separator described above and illustrated in FIGS. 1A and 1B functions to receive an air-oil mixture by a pressure differential maintained between the air-oil mixture inlet ports 138 and a separator housing air outlet port 144. More specifically, the pressure differential or vacuum created within the separator is regulated so that it does not exceed a predetermined amount. In such a vacuum related environment the air-oil separator functions to separate the entering air-oil mixture into its oil and air constituents in the following manner. An air-oil mixture is passed into the separator housing 102 through the inlet ports 138, and is thereafter routed into a first airflow passageway 146 that is defined between the separator housing lid 112 and the filter housing closed end 118. As will be described in greater detail below, the vacuum regulator 142 is sealed to prevent the air-oil mixture introduced by the inlet ports 138 from passing to any other portion of the separator except the first passageway 146. If desired, a filter material may be used in the first passageway for purposes of providing an initial prefiltering and oil coalescing of the incoming air-oil mixture to further enhance oil separation, as more fully described below.

After passing through the first airflow passageway 146, the air-oil mixture is directed axially downwardly through the second annular passageway 122 defined between the concentrically opposed separator housing and filter housing sidewalls 108 and 120. The air-oil mixture entering the second airflow passageway 122 is routed axially downwardly towards the separator housing base 106. As the air-oil mixture is passed through the first and second airflow passageways its temperature is reduced by contact/collision with the relatively lower temperature separator housing and filter housing sidewall surfaces. Such conductive cooling causes a portion of the oil constituent of the entering air-oil vapor mixture to condense out of the vapor. The condensed portion of the oil runs downwardly through the second airflow passageway 122 and is collected along the base 106 of the separator housing.

The air-oil mixture is passed downwardly through the second airflow passageway 122 until it reaches the filter housing open end 116, at which point the air-oil mixture is drawn radially inwardly towards the exposed portion 132 of the oil coalescing filter element 124. The air-oil mixture flow path through the filter element follows a path of least resistance, staring from the exposed bottom portion of the filter element, and then moving axially upwardly along an annular channel 130 defined between the filter element outer surface 128 and the filter housing sidewall 120 as oil coagulates along the exposed filter element portion. Accordingly, as discussed above, the filter element is sized and configured to fit within the filter housing so that a sufficient annular space 130 is provided to enable handling a specific volumetric flow rate of crankcase fumes therebetween.

As the air-oil mixture encounters the filter element, the oil constituent coalesces along the filter element surface and drains by gravity downwardly to the separator housing base 106, and is not passed radially through the filter element to the chamber 136. The separated air constituent is passed radially directed by vacuum towards the vacuum regulator 142. The separated air is passed into the vacuum regulator, via one or more inlets 148 extending through the filter housing closed end 118, and is removed from the separator housing via the outlet port 144 centrally mounted atop the lid 118 and in air flow communication with the regulator 142. The air exiting the separator housing passes through the outlet port 144 and to an engine air intake system via suitable hoses, tubing, and the like.

As the air-oil mixture is passed through the first and second airflow passageways 146 and 122, respectively, it both loses velocity and comes into contact with the relatively cooler surfaces of the separator and filter housings. The combined reduction in velocity and cooling serves to separate the oil entrained within the entering mixture, where it flows by gravity to the bottom of the housing for collection and removal via the oil drains 140. The air-oil mixture is further passed though the oil coalescing filter 124, where the remaining portion of oil is separated from the air and is collected for removal, and the separated air is passed through the filter to the chamber 136. Accordingly, the air that is routed through the chamber to the vacuum regulator is substantially oil free for combining with the engine intake air once removed from the separator for subsequent combustion.

Figure 2:
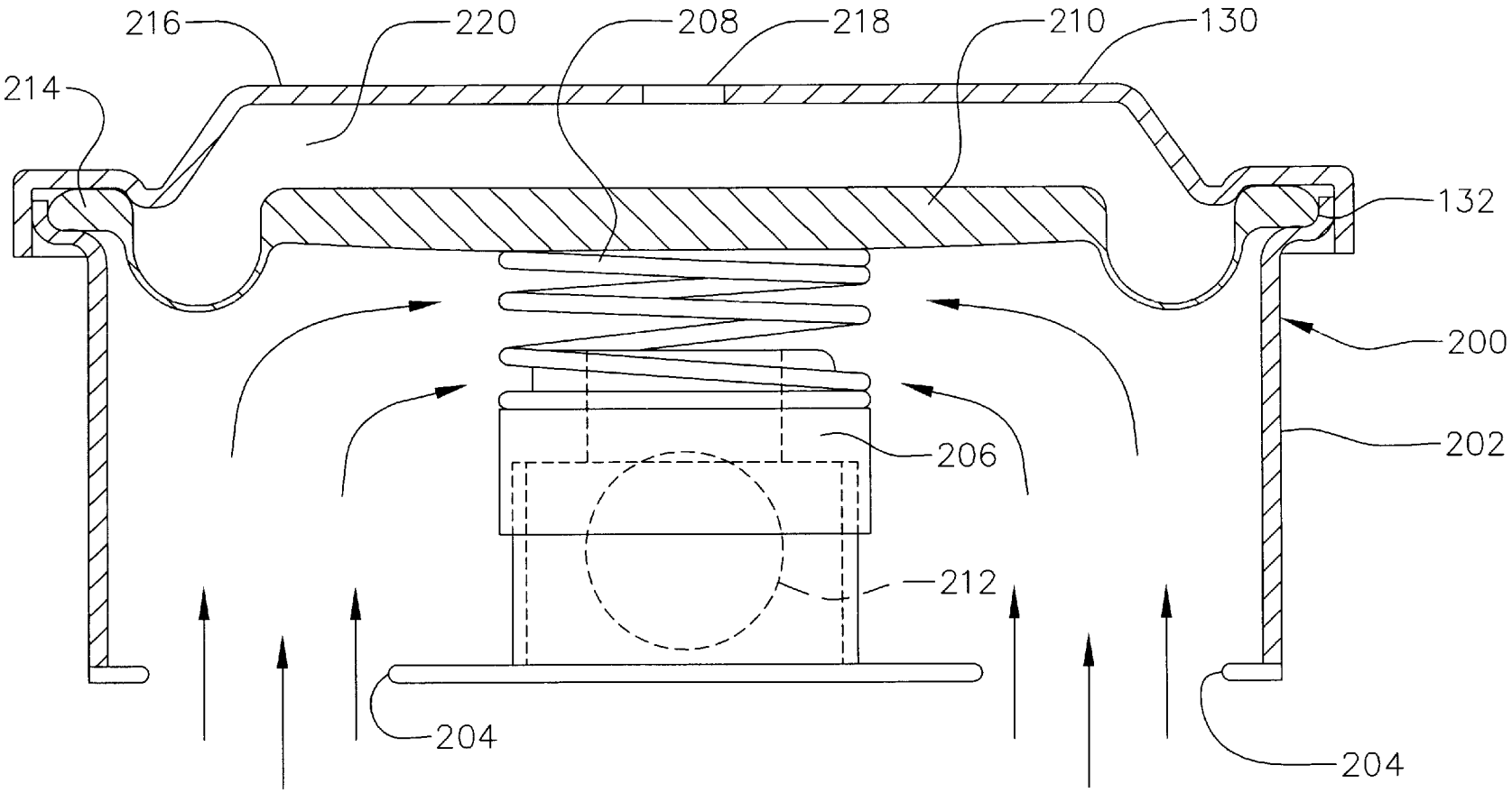
FIG. 2 is a cross-sectional side view of a vacuum regulator used in conjunction with an air-oil separator constructed according to principles of this invention.

It should be understood that vacuum control within the separator may be provided by various means, such as by a control valve, an on/off valve, a pressure regulator, and the like. The first embodiment separator of FIGS. 1A and 1B illustrate an example embodiment comprising a diaphragm operated vacuum regulator 144 integral with the separator. As best shown in FIG. 2, the vacuum regulator 200 comprises a housing 202 in the form of a wall that extends upwardly away from the filter housing closed end 118 within the first airflow passageway 146 towards the separator housing lid 112. It is desired that the regulator housing 202 be formed from a structurally rigid material that is compatible with the material chosen for the canister.

The vacuum regulator 200 comprises a number of inlet openings 204 therethrough to facilitate the passage of air into the regulator housing 202 from the chamber 136. A spring seat 206 is disposed within the housing and is configured to accommodate placement of a spring 208 and a movable diaphragm 210 thereon. An outlet port 212 extends from a portion of the spring seat 206 and is configured to transport air that is received into the vacuum regulator from the chamber 136, and that passes across the diaphragm 210, to the separator outlet port 144. The vacuum regulator can be positioned radially with respect to the central axis 28 anywhere within the air-oil separator housing such that its inlet openings 204 are in communication with the chamber 136. In an example embodiment, as best illustrated in FIG. 1B, the vacuum regulator 142 is offset radially from the central axis 110 to permit placement of the separator outlet port 144 in the center of the housing lid 112. It is, however, to be understood that the placement of the vacuum regulator may vary depending on the particular separator application and related packaging requirements.

The spring seat 206 is configured to retain one end of the spring 208 in a fixed position during reciprocating diaphragm movement thereon. The spring seat can be formed from any suitable structurally rigid material, and can either be permanently or removably attached Lo the outlet port 212. The spring 208 is sized card configured to provide a desired maximum amount of vacuum within the air-oil separator 100, and directed to an engine crankcase, when combined with the other elements forming the vacuum regulator. It is desired that the spring be selected to impose a slight vacuum within the air-oil separator 100 and on an engine crankcase to extract the oil-air mixture from the engine crankcase without both interfering with the efficient separation and collection of the air and oil constituents within the air-oil separator, and causing oil and oil laden air to be carried over from the crankcase. In an example embodiment, the spring is selected to provide a maximum vacuum within the air-oil separator of from about −6 to 6 inches of water, and more preferably approximately 2 inches of water. It is to be understood, however, that the desired vacuum operating range within a separator can and will vary depending on the particular application according to the suggested operating vacuum range provided by each different engine/vehicle manufacturer.

The movable diaphragm 210 is disposed over an end of the spring 208 opposite the spring seat 206 and includes an underside surface adjacent the spring seat configured to provide an air-tight seal against the spring seat when a maximum vacuum is encountered. The diaphragm 210 includes a lip 214 that extends circumferentially therearound and that defines a distal end of the diaphragm, which lip is interposed between the regulator housing 202 and a regulator cover 216 to attach the diaphragm within the regulator housing. The cover 216 includes an opening 218 therethrough to expose an air cavity 220, formed between the cover 216 and diaphragm 210, to atmospheric pressure air. The need to provide atmospheric pressure air to the vacuum regulator air cavity is critical to the proper functioning of the diaphragm to react to changes in vacuum at the outlet port 212 (and connected separator outlet port 144) and the regulator inlet openings 204.

The vacuum regulator is designed to impose a slight vacuum in the crankcase, via connection with the air-oil separator. The presence of oil droplets or particles in the crankcase atmosphere is due partly to the relatively high pressure in the crankcase. By connecting an air-oil separator exposed to a vacuum regulated environment, the pressure in the crankcase is eliminated and an actual slight vacuum replaces the high pressure crankcase atmosphere. This serves to significantly decrease the amount of oil, contaminants and blowby byproducts entrained in the crankcase air, and may significantly reduce oil consumption. It is significant that the vacuum created in the crankcase not be too large to avoid the unwanted carryover of oil pulled from the crankcase and into the air-oil separator.

The vacuum regulator limits the vacuum that is both maintained within the air-oil separator and in the crankcase by diaphragm movement vis-a-vis the outlet port 144. If the vacuum developed by an engine intake system external from the air-oil separator is greater than a predetermined maximum, the differential pressure on opposite sides of the diaphragm 210 causes the diaphragm to overcome the biasing pressure of the spring 208 and cause the diaphragm to form an air-tight seal against the spring seat 206 to seal off the air-oil separator from the vacuum generating source.

Once the diaphragm is sealed against the spring seat 206, air flow through the air-oil separator is terminated. Once the vacuum developed by the vacuum generating source is reduced to a level below the predetermined maximum, the differential pressure acting on the diaphragm is reduced and the biasing pressure of the spring is restored, causing the diaphragm to move away from the spring seat 206. Once the air-tight seal between the diaphragm and the spring seat is broken, airflow through the vacuum regulator, through the air-oil separator, and from the engine crankcase s restored. Operation in this manner provides a closed crankcase ventilation system.

Additionally, air-oil separators of this invention can include one or more pressure relief or pop-off valves 150 (as best shown in FIG. 1B). The pop-off valves can be within the housing upstream from the filter element 124 for the intended purposes of relieving pressure that may build up within the air-oil separator 100 in the event that air flow through the filter element is impaired. For example, in the event that the filter element becomes clogged with oil or particulate matter preventing a desired vacuum to be communicated to the engine crankcase, built up pressure within the crankcase can be relieved via the pop-off valves.

The pop-off valves can be configured to relieve built up pressure away from the housing and to the environment for applications where a completely closed emission system is not necessary. Alternatively, the pop-off valves can be configured to relieve built up pressure around the filter element and to the vacuum source, i.e., avoiding relief to the environment, for applications where a completely closed emission system is desired. In an example embodiment, where a completely closed emission system is desired, the pop-off valves are configured having outlet ports that are routed to relieve the built-up pressure to the separator outlet port for removal from the air-oil separator. In an example embodiment, the pop-off valves are configured provide pressure relieve at positive pressures within the housing of greater than about 6 psig. Again, it is to be understood that the pressure relief settings for the pop-off valves will vary depending on the particular air-oil separator application.

Figures 3A, 3B:
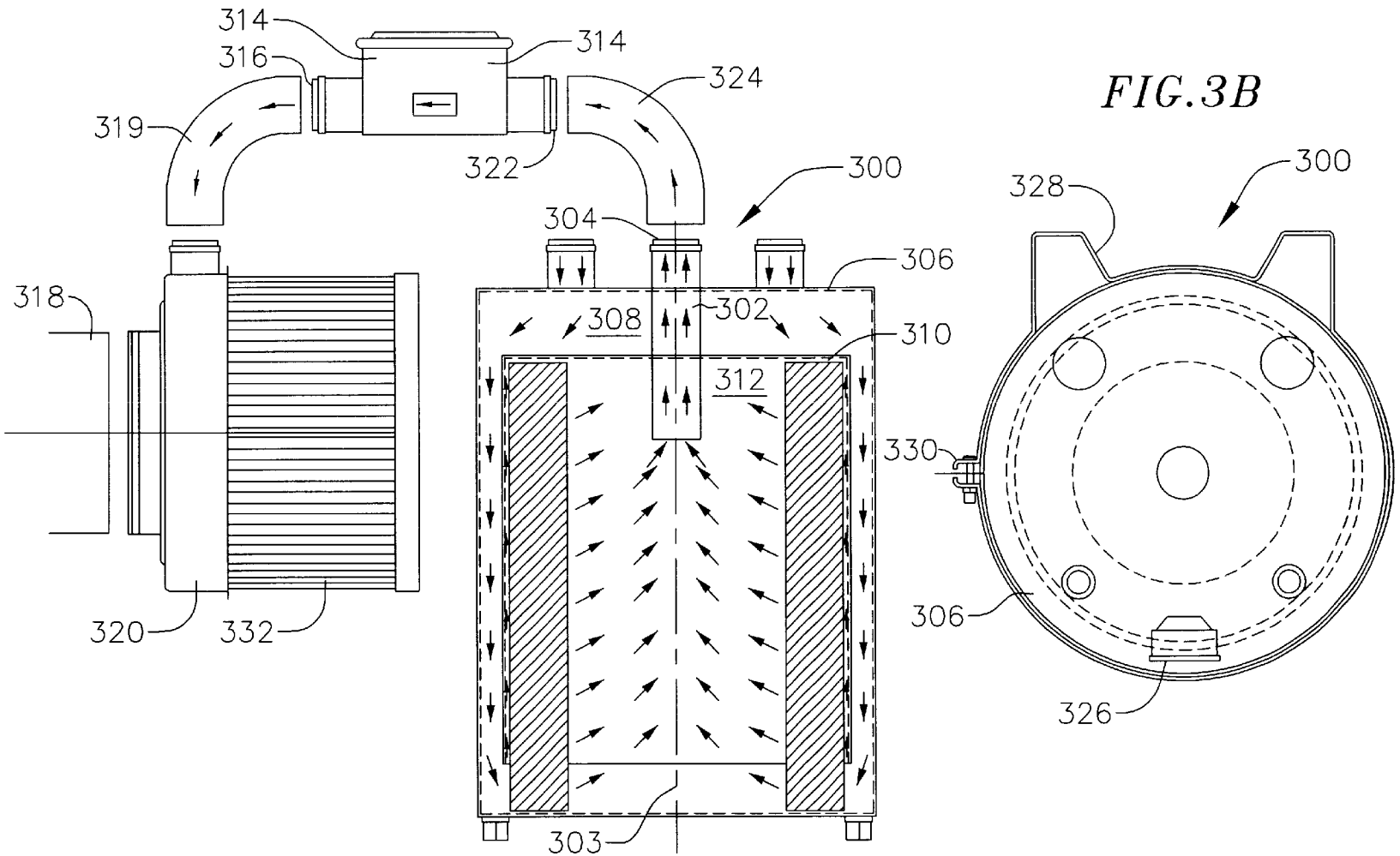
FIGS. 3A and 3B are a cross-sectional side view and a top plan view, respectively, of a second embodiment air-oil separator constructed according to principles of this invention.

FIGS. 3A and 3B illustrate a second embodiment air-oil separator 300 constructed according to principles of this invention. The second embodiment air-oil separator 300 is similar to the first embodiment air-oil separator 20 disclosed above and illustrated in FIGS. 1A and 1B, except that it does not include an onboard or integral vacuum control means. Rather, the second embodiment air-oil separator 300 comprises an output tube 302 that extends axially from one tube end 304, downwardly through the separator lid 306, through the first airflow passageway 308, through the filter housing closed end 310, and into the chamber 312.

The outlet tube 302 can be in the form of a single tubular member, or can be in the form of two or more tubular members that are connected together. The outlet tube 302 is placed through the lid 306 and the filter housing closed end 310 in a manner forming a leak-tight seal therewith, either by use of sealing materials or by use of appropriately sized and configured sealing gaskets, e.g., O-ring seals. The outlet tube 302 can be positioned through the air-oil separator at any radial position relative to the axis 303, depending on the particular separator application and related packing requirement. In an example embodiment, the outlet tube 302 is positioned through the air-oil separator along the axis 303 to provide more room for accommodating the coalescing filter element.

Rather than depending on a vacuum control device mounted within the air-oil separator, the second embodiment separator uses an off-board or external vacuum control device 314 to regulate the vacuum environment within the air-oil separator and ultimately directed to the engine crankcase. The vacuum control device 314 can be of the same type as that discussed above and illustrated in FIG. 2 for the first embodiment separator, and in an example embodiment is in the form of a vacuum regulator. Such vacuum regulator functions in the same manner as described above to limit the amount of vacuum directed to the air-oil separator, provided by an engine intake system, to a predetermined maximum. Thus, identical to the first embodiment separator discussed above, the second embodiment air-oil separator performs air-oil separation, collection, and removal within a vacuum controlled environment.

The external vacuum control device 314 is connected at an outlet end 316 to an appropriate vacuum source 318, such as an engine air intake system, via appropriate connection hosing or tubing 319. As shown in FIG. 3A, an engine air filter housing 320 can be interposed between the engine air intake system 318 and the connection hosing 319 for purposes of integrating the separated air received from the air-oil separator with filtered primary air. A vacuum control device outlet end 322 is connected via appropriate connection hosing or tubing 324 to the air-oil separator outlet tube end 304. Connected in this manner, the external vacuum control device 314 serves to regulate the amount of vacuum directed to the air-oil separator for facilitating the passage of separated air from the separator to the engine air intake system for subsequent combustion.

FIG. 3B illustrates an optional feature that can be included on all embodiments of air-oil separators of this invention; namely, a restriction indicator 326. In an example embodiment, the restriction indicator can be any type of device that is capable of indicating, visually or otherwise, the pressure or vacuum condition within the housing. In an example embodiment, the restriction indicator is in the form of a pressure gauge that is attached to the separator 300 in a manner that permits easy viewing. The pressure gauge is positioned in such a manner as to permit access to the internal portion of the separator upstream from the filter element, i.e., to permit monitoring the pressure or vacuum condition that is imparted to the engine crankcase. The pressure gauge 326 enables one to determine whether a predetermined minimum amount of vacuum exists within the separator airflow passageway to permit proper operation of the separator. A vacuum reading below the predetermined minimum, or a pressure reading above a predetermined maximum, indicates that the filter element may be clogged and that servicing/replacement of the filter element is required. In an example embodiment illustrated in FIG. 3B, the pressure gauge is mounted on top of the lid 306, to permit easy viewing, and includes a sensor end that is in communication with the airflow passageway 308 in the separator upstream from the filter element.

Figure 4:
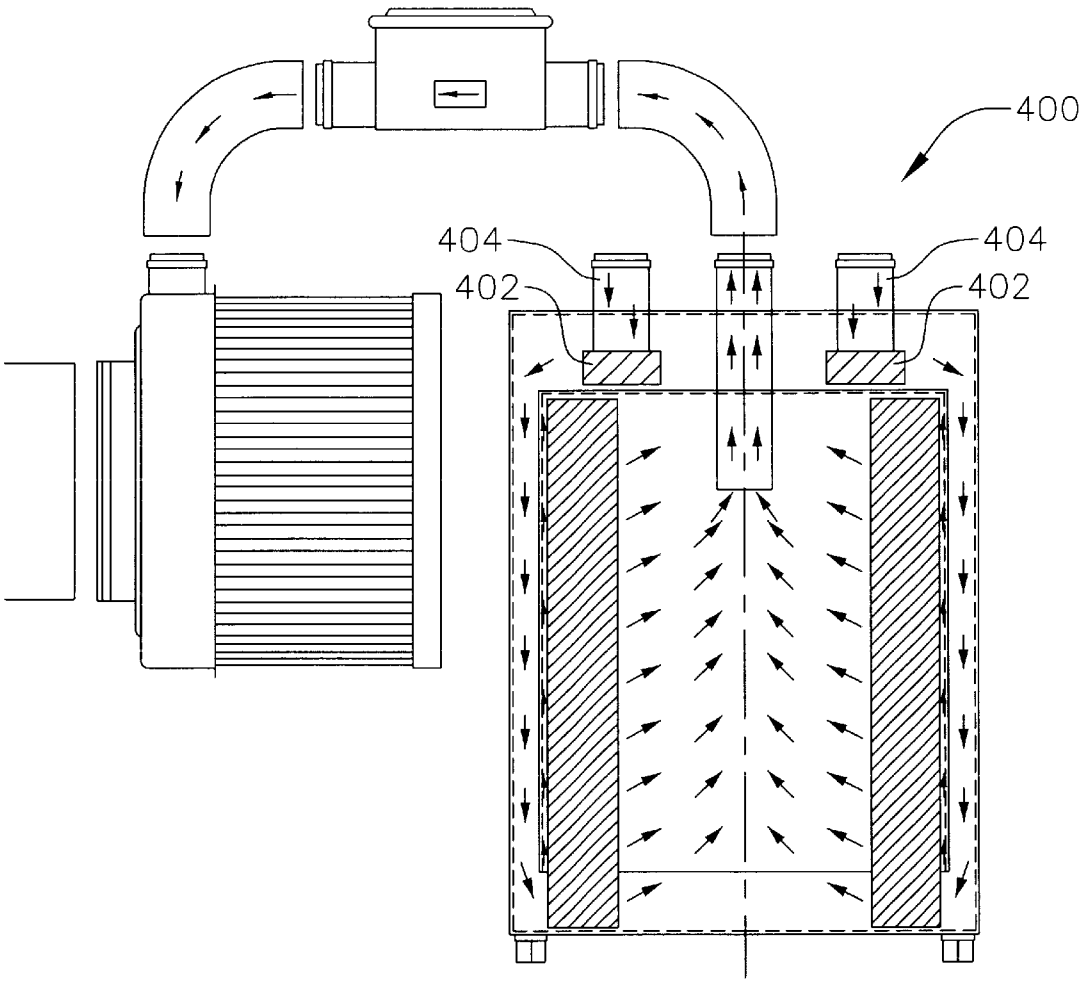
FIG. 4 is a cross-sectional side view of a third embodiment air-oil separator constructed according to principles of this invention.

FIG. 4 illustrates a third embodiment air-oil separator 400 constructed according to principles of this invention. The third embodiment air-oil separator 400 is similar to the second embodiment air-oil separator 300 disclosed above and illustrated in FIGS. 3A and 3B, except that it includes one or more optional oil coalescing prefilters 402 positioned at an outlet end of the inlet port 404. The prefilters 402 are used to provide a first stage of oil coalescing for larger particles at the air-oil mixture first enters the separator, before being passed through the second airflow passageway and to the filter element.

The prefilter can be formed from the same types of materials described above for forming the primary coalescing filter element, e.g., conventional filter materials such as paper, polymer materials, ceramic materials and the like. In an example embodiment, the prefilter is formed from woven fiberglass and cellulose, and is mounted at an outlet end of the inlet port 404 such that the air-oil mixture must pass through the prefilter before passing into the first and second airflow passageways. In a preferred embodiment, the air-oil separator comprises two prefilters 402, each mounted adjacent a respective inlet port 404. The prefilters help to reduce airflow velocity through the separator, thereby enhancing oil separation and increasing air-oil mixture residency time.

Although the prefilter has been described and illustrated as being onboard or integral with the separator, it is to be understood that the prefilter can also be located off board or external from the separator. For example, the prefilter can be located in a breather housing or breather cap, e.g., 503 in FIG. 5, of the engine crankcase so that an air-oil mixture leaving the crankcase first must pass through the prefilter before being routed to the separator. Whether the prefilter will be positioned onboard or off board the separator will depend on the particular separator application. Thus, it is to be understood that separators of this invention are intended to include either type of prefilter.

While the prefilter has been discussed and illustrated with respect to the separator embodiment comprising an external vacuum control device, it is to be understood that all embodiments of the air-oil separator of this invention can include the onboard or off board prefilter. The prefilter use used to perform a first stage filtering of the air-oil mixture before it is passed to the primary coalescing filter element, thereby serving to prolong the service life of the filter element.

Figure 5:
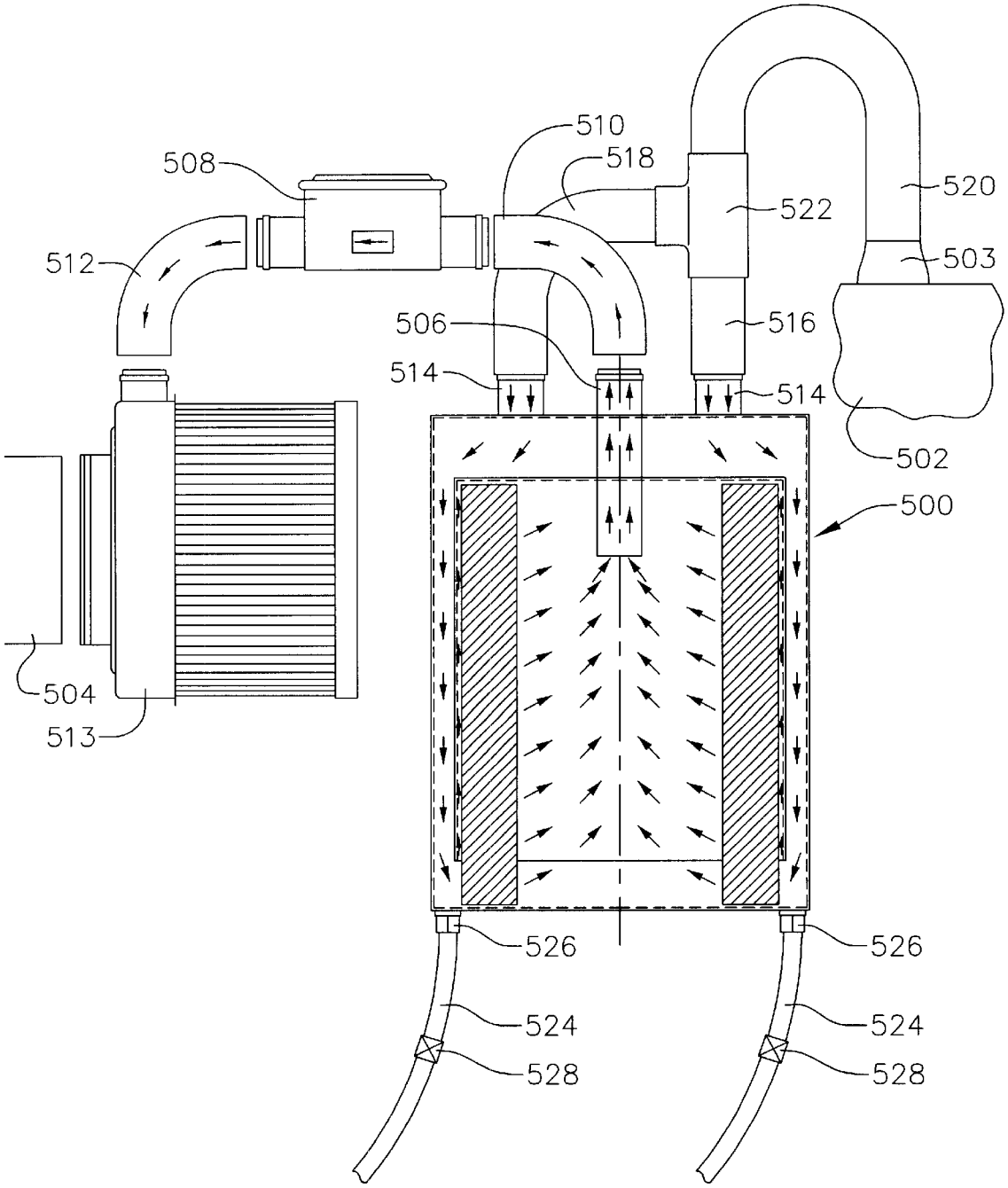
FIG. 5 is a schematic view of an internal combustion engine emission control system comprising an air-oil separator constructed according to principals of this invention.

FIG. 5 illustrates an embodiment of the air-oil separator 500, in substantially the same form as that of the second separator embodiment discussed above, as connected with an internal combustion engine crankcase 502 and an engine intake system 504. The air-oil separator 500 is connected to the engine air intake system 504 in the manner described above with reference to the second embodiment and FIG. 3A, e.g., the separator outlet port 506 is attached the engine intake system 504 via the vacuum control device 508, appropriate tubing 510 and 512, and an appropriate air filter housing 513. In the event that the engine is a diesel engine, the air filter housing is coupled to the engine's intake air turbo. Alternatively, engines without turbos have the air filter housing 513 coupled to the induction system for the engine. Generally, the air-oil separator of this invention can be adapted to connect with the crankcase and clean air intake system of any internal combustion engine.

The separator inlet ports 514 are connected to an engine crankcase 502, e.g., an engine crankcase valve cover breather housing or breather cap 503, via appropriate tubing 516, 518, 520, and any necessary tube connector fittings 522, e.g., a tee connection fitting. Fluid lines 524 are connected to the oil drain couplings 526 on the bottom of the separator housing to remove collected oil from the separator. The fluid lines can be connected to the engine's oil reservoir for purposes of directing collected oil back into the engine. If desired, check valves 528 can be attached between the oil drain couplings 526 and the engine oil reservoir to prevent oil from being sucked up out of the oil reservoir into the separator.

As illustrated in FIG. 3B, air-oil separators 300 of this invention can be attached remote from the engine to take advantage of the relatively cooler environment inherent in positioning the separator away from the engine. Positioning the air-oil separator in relatively cool environment helps to improve oil separation by conduction within the airflow passageways, thereby improving the oil separation efficiency. In an example embodiment, the separator can be attached inside or outside of the engine compartment, by use of an attachment ring assembly 328 configured to removably embrace an outside diameter of the separator housing.

The separator 300 is removably held in the attachment assembly by use of a nut-and-bolt attachment 330 at ring ends. The attachment assembly can be opened for removing or receiving the separator, by loosening and detaching the nut-and-bolt attachment, and closed for containing the separator by connecting the threadably tightening the nut-and-bolt attachment. While a particular type of attachment assembly has been described and illustrated, it is to be understood that other means known in the art for attaching the separator to another member can be used and are understood to be within the scope of this invention.

With reference to FIG. 1B, with the connections illustrated in FIGS. 3A and 5, air-oil separators of this invention operate in the following manner. As the engine is operated a vacuum is created within either the engine's intake air turbo (in the case of a diesel engine) or within the engine's air-fuel induction system. Air is pulled through the air filter 332, through the air filter housing or manifold 320. The pulling effect within the air filter housing 320 creates a pressure differential between the air filter housing 320 and the vacuum control device 314, whether positioned onboard or off board of the air-oil separator. A controlled amount of the pressure differential or vacuum imposed on the vacuum control device is passed to the air-oil separator, and is passed to an engine crankcase breather 503 via appropriate hoses 516, 518, 520, and fittings 522. The pressure differential between the inlet ports 50 and the outlet port 54, is regulated by action of the vacuum regulator as described above.

Contaminated air evacuated from the engine breather 503 is introduced into the separator first airflow passageway so that the entering air-oil mixture collides with the filter housing closed end 35. Alternatively, if the separator is used with the oil coalescing prefilters (as shown in FIG. 4), the entering air-oil mixture first collides with the prefilters before being passed into the first airflow passageway.

As the oil-contaminated air passes through the separator first and second airflow passageways, oil in the contaminated air impacts and condenses on the surfaces of the filter and/or separator housing, and is collected by gravity along the separator housing base. Remaining oil-contaminated air is passed through the oil coalescing filter element, whereby separated oil is collected by gravity along the base of the separator housing and separated air is passed radially through the filter element into the chamber. The decontaminated air then either flows out of the separator (in the event that the vacuum control device is external from the separator) to the vacuum control device, or into the vacuum control device (in the event that the vacuum control device is integral with the separator). In either case, the separated air is routed out of the vacuum control device and into the air filter housing, where it merges with just-filtered intake air for subsequent combustion. Alternatively, the separated air can be emitted to the atmosphere for those applications calling for an open system.

Oil that is separated from the entering contaminated air flows by gravity to the bottom of the separator housing, where it is collected and routed through the oil drains 526 into the fluid lines 524 where it develops a sufficient head pressure that allows it to pass through the check valve 528 and to the engine's oil reservoir.

The air-oil separator of this invention may be designed for use with any type of engine, and its efficiency of can be changed by varying the tolerances and/or surface areas with the separator and filter housings, by changing the type, size, and/or configuration of the oil coalescing prefilter and/or filter element, by changing the predetermined maximum vacuum environment within the separator, by changing the diameters of the inlet and outlet ports, and the like.

A key feature of air-oil separators of this invention, aside from the advantages in operating efficiency and ease of access gained by mounting the separator remotely from the engine is, that the air-oil separator has a vacuum controlled environment, which provides further improvements in air and oil separation efficiency by reducing flow velocity and increasing residency time within the separator. Another feature of air-oil separators of this invention is the use of a filter element that is serviceable, i.e., removable and replaceable, by simply removing the separator housing lid, and removing the filter housing from the separator housing.

Accordingly, once a filter element becomes clogged or otherwise performs improperly, one can simply replace the filter element without having to replace the entire separator. A still other feature of air-oil separators of this invention is the use of an onboard or off board prefilter to perform first stage filtering of the air-oil mixture before it is routed to the primary oil coalescing filter for purposes of extending primary oil coalescing filter life.

Although limited embodiments of remote air-oil separators of this invention have been described herein, many modifications and variations will be apparent to those skilled in the art. Accordingly, it is to be understood that, within the scope of the appended claims, remote air-oil separators of this invention may be prepared other than as specifically described herein.

What is claimed is:

1. An air-oil separator system comprising:

a housing comprising an internal chamber, an inlet for receiving an air-oil mixture from an internal combustion engine into the internal chamber, and an outlet for passing a separated air stream from the internal chamber and out of the housing, wherein the housing has a closed end at one axial end, an open end and an opposite axial end, and a wall surface extending between the open and closed ends, the housing further comprising a removable lid attached to the housing open end, wherein the inlet and outlet are each disposed through the lid;

a filter removably disposed within the internal chamber and positioned between the inlet and outlet;

a filter housing removably disposed within the separator housing and including a closed end at one axial end oriented adjacent the separator housing open end, an open end at an opposite axial end oriented adjacent the separator housing closed end, and a wall surface extending therebetween wherein the filter element is removably disposed within the filter housing;

a first airflow passageway defined between the separator housing lid and the filter housing closed end for receiving an air-oil mixture from the inlet;

a second airflow passageway in communication with and downstream from first airflow passageway for directing an air-oil mixture to the filter element, the second airflow passageway defined by an annular space between adjacent separator housing and filter housing wall surfaces; and means for controlling a pressure differential within the housing internal chamber between the inlet and outlet, the means for controlling being downstream of the filter and in communication with the outlet and a vacuum generating source.

2. The air-oil separator system as recited in claim 1 wherein the means for controlling is positioned within the housing.

3. The air-oil separator system as recited in claim 1 wherein the means for controlling is positioned external from the housing.

4. The air-oil separator system as recited in claim 1 further comprising a prefilter positioned onboard or off board of the housing for receiving an air-oil mixture before it is passed to the filter.

5. The air-oil separator system as recited in claim 1 wherein at least a portion of the filter element projects axially outwardly from the filter housing open end and is exposed to the second airflow passageway.

6. The air-oil separator system as recited in claim 1 wherein the filter element has an outside diameter that is sufficiently less than an inside diameter of the filter housing to permit the passage of the air-oil mixture into an annular space provided therebetween and to the filter element.

7. The air-oil separator system as recited in claim 1 wherein the filter housing includes a chamber defined within an inside diameter of the filter element, wherein the outlet is positioned within the separator in airflow communication with the filter housing chamber to receive separated air that has bee passed through the filter element for routing away from the separator housing.

8. The air-oil separator system as recited in claim 7 wherein the means for controlling is positioned within the separator and is interposed in airflow communication between the filter housing chamber and the outlet.

9. The air-oil separator system as recited in claim 7 wherein the means for controlling provides a vacuum controlled environment within the first airflow passageway, the second airflow passageway, and the filter housing chamber of in the range of from −6 to 6 inches of water.

10. An air-oil separator system comprising:

a housing comprising an internal chamber defined by a housing sidewall surface extending axially from a base to an open end, the open end including a removable lid disposed thereon, the housing including an inlet for receiving an air-oil mixture into the internal chamber from an internal combustion engine, and an outlet for passing a separated air stream from the internal chamber and out of the housing;

a filter housing removably disposed within the internal chamber and including a filter element removably disposed therein, the filter housing and filter element being positioned within the internal chamber between the inlet and outlet;

means for controlling a pressure differential within the internal chamber between the inlet and outlet, the means for controlling being downstream of the filter element and in communication with the outlet and a vacuum generating source; and an airflow passageway extending within the internal chamber from the inlet along an outside surface of the filter housing.

11. The air-oil separator system as recited in claim 10 a prefilter disposed onboard or off board of the housing within an air-oil mixture flow path upstream from the filter element.

12. The air-oil separator system as recited in claim 10 wherein the filter element has an outside diameter that is sufficiently less than an inside diameter of the filter housing to permit the passage of the air-oil mixture from the airflow passageway into an annular space provided therebetween and to the filter element.

13. The air-oil separator system as recited in claim 10 wherein the filter element is interposed axially between and forms a leak-tight seal with the filter housing and the housing base to provide a forced airflow path from the airflow passageway through the filter element.

14. The air-oil separator system as recited in claim 13 wherein at least a portion of the filter element adjacent the housing base projects a distance beyond the filter housing and is exposed to the airflow passageway.

15. The air-oil separator system as recited in claim 10 wherein the means for controlling is disposed within the internal chamber.

16. The air-oil separator system as recited in claim 10 wherein the means for controlling is external from the housing.

17. An air-oil separator system comprising:

a housing having an internal chamber defined by a sidewall surface extending axially between opposed closed axial ends, the housing including an inlet for receiving an air-oil mixture into the internal chamber from an internal combustion engine, and an outlet for passing a separated air stream from the internal chamber and out of the housing;

a filter housing disposed within the internal chamber and including a filter element disposed therein, the filter housing and filter element being disposed between the inlet and outlet, the filter housing including an air chamber defined by an inside diameter of the filter element that is in air flow communication with the outlet;

an airflow passageway defined between the housing and the filter housing and in air flow communication with the inlet for passing an air-oil mixture the filter element; and means for controlling a pressure differential within the internal chamber between the inlet and outlet, the means for controlling being disposed within the housing downstream from the filter housing air chamber and in air flow communication with the outlet and a vacuum generating source;

wherein the filter element has an outside diameter that is sufficiently less than an inside diameter of the filter housing to permit the passage of the air-oil mixture from the airflow passageway into an annular space provided therebetween and to the filter element.

18. The air-oil separator system as recited in claim 17 wherein she filter element is interposed axially between and forms a leak-tight seal with the filter housing and the housing base to provide a forced airflow path from the airflow passageway through the filter element.

19. The air-oil separator system as recited in claim 17 wherein at least a portion of the filter element adjacent the housing base projects a distance beyond the filter housing and is exposed to the airflow passageway.

20. The air-oil separator system as recited in claim 17 further comprising an air-oil mixture prefilter positioned within an air-oil mixture flow path upstream of the filter element.

21. The air-oil separator system as recited in claim 17 further comprising an air-oil mixture prefilter positioned within an air-oil mixture flow path upstream of the filter element.

22. An air-oil separator system comprising:

a housing having an internal chamber defined by a sidewall surface extending axially between opposed closed axial ends, the housing including an inlet for receiving an air-oil mixture into the internal chamber from an internal combustion engine, and an outlet for passing a separated air stream from the internal chamber and out of the housing;

a filter housing disposed within the internal chamber and including a filter element disposed therein, the filter housing and filter element being disposed between the inlet and outlet, the filter housing including an air chamber defined by an inside diameter of the filter element that is in air flow communication with the outlet;

an airflow passageway defined between the housing and the filter housing and in air flow communication with the inlet for passing an air-oil mixture the filter element; and means for controlling a pressure differential within the internal chamber between the inlet and outlet, the means for controlling being external from the housing and in air flow communication with the outlet and a vacuum generating source;

wherein the filter element has an outside diameter that is sufficiently less than an inside diameter of the filter housing to permit the passage of the air-oil mixture from the airflow passageway into an annular space provided therebetween and to the filter element.

23. The air-oil separator system as recited in claim 22 wherein the filter element is interposed axially between and forms a leak-tight seal with the filter housing and the housing base to provide a forced airflow path from the airflow passageway through the filler element.

24. The air-oil separator system as recited in claim 22 wherein at least a portion of the filter element adjacent the housing base projects a distance beyond the filter housing and is exposed to the airflow passageway.

* * * * *